US005648788A

United States Patent [19]

Bumsted

[11] Patent Number: 5,648,788

[45] Date of Patent: Jul. 15, 1997

[54] MOLDED CELLULAR ANTENNA COIL

[75] Inventor: Thomas C. Bumsted, Elgin, Ill.

[73] Assignee: D & M Plastics Corporation, Burlington, Ill.

[21] Appl. No.: 636,241

[22] Filed: Apr. 23, 1996

Related U.S. Application Data

[62] Division of Ser. No. 415,336, Apr. 3, 1995, Pat. No. 5,596, 797.

[51] Int. Cl.[6] ..... H01Q 1/36; H01Q 1/40

[52] U.S. Cl. ..... 343/895; 343/873; 343/702

[58] Field of Search ..... 343/702, 873, 343/895; 29/600; 336/192, 208

[56] References Cited

U.S. PATENT DOCUMENTS

| | | | |
|---|---|---|---|
| 3,737,910 | 6/1973 | Francis et al. | 343/895 |
| 3,745,498 | 7/1973 | Hagood | 336/192 |
| 4,058,811 | 11/1977 | Gauss et al. | 343/873 |
| 4,063,206 | 12/1977 | Walker, III | 336/192 |
| 4,725,395 | 2/1988 | Gasparaitis et al. | 343/895 |
| 5,341,149 | 8/1994 | Valimaa et al. | 343/873 |
| 5,504,494 | 4/1996 | Chatzipetros et al. | 343/895 |

*Primary Examiner*—Donald T. Hajec
*Assistant Examiner*—Tan Ho
*Attorney, Agent, or Firm*—Mathew R. P. Perrone, Jr.

[57] ABSTRACT

An antenna for a wireless communicating device can be set at a precise frequency, in the as formed state. A coil antenna is precisely held in a mold, while an appropriate plastic is molded therearound, with no distortion of the coil, to fix a precise shape for the coil. The recovered, plastic-encased coil requires little or no follow-up treatment before it can be used in a wireless communication device as an antenna.

5 Claims, 11 Drawing Sheets

FIG-9-
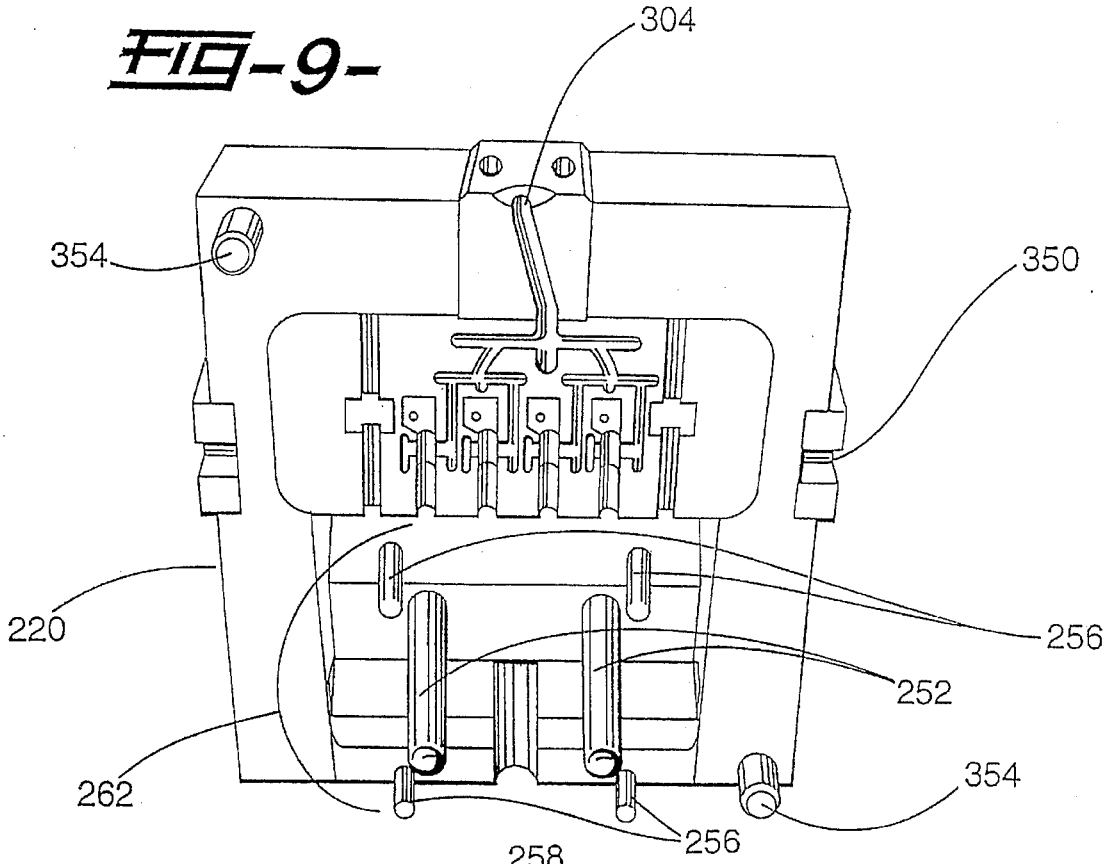
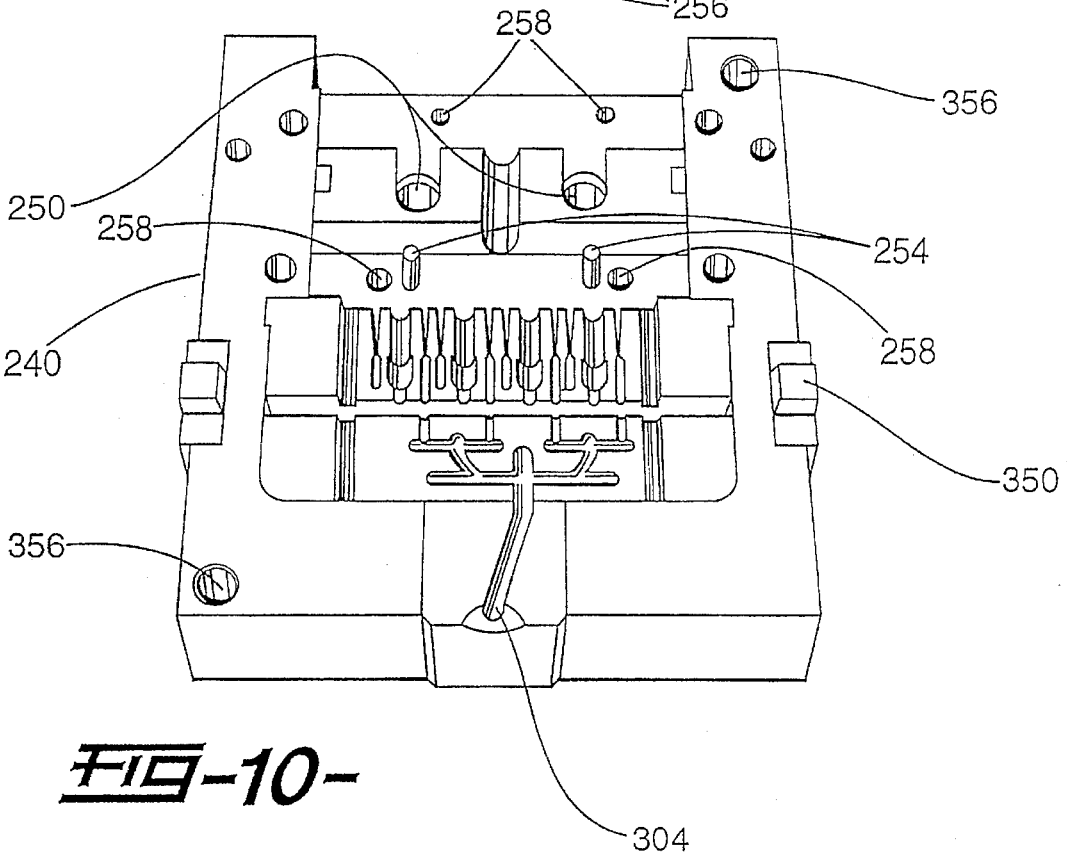
FIG-10-

MOLDED CELLULAR ANTENNA COIL

CROSS-REFERENCE TO RELATED APPLICATION

This application is a divisional application of U.S. patent application Ser. No. 08/415,336, filed Apr. 3, 1995 now U.S. Pat. No. 5,596,797.

BACKGROUND OF THE INVENTION

This invention relates to a cellular antenna coil; and, more particularly, to a molded cellular antenna coil encapsulated in a resin material for holding the antenna coil in the proper position at a specific dimension for maximum effectiveness for use in a wireless communication device, and a method and an apparatus for making the same.

Currently, contemporary mass produced wireless communication devices, such as: a cellular telephone, a pager, or a similar device, are dependent on the use of sophisticated, specially tuned antennas to perform the function of sending and receiving the radio-wave signals, that they require to function. The recent introduction of digital technology on a widespread and growing basis continues to place further performance demands on antennas. In order for a wireless communication device to operate at maximum efficiency, the signal quality must be maintained.

In an antenna for a cellular telephone, it is especially critical to provide an extremely specific dimension for the antenna to achieve the maximum effectiveness for the cellular telephone as to range and clarity of signal. With this specific dimension maintained, the maximum effectiveness of the antenna, and hence the telephone or other communication device, is achieved.

For any wireless communication device, the antenna must be tuned to a specific radio frequency and be capable of rejection of all other unwanted radio frequencies to prevent reception from fading. Any antenna for such a device must be engineered to send and receive signals within a very specific radio frequency range. The effectiveness (and even the basic ability to function) of a wireless communication device is intimately linked to the consistent performance of the antenna assembly.

In the United States, these operating frequencies are mandated and assigned by the Federal Communication Commission. In other countries, they are likewise assigned by the appropriate governmental regulatory agencies in specific countries. In order for the antenna to perform within the strict frequency parameters mandated by the United States and foreign governments, the antenna assembly must be manufactured to extremely exacting, difficult to reproduce, tolerances and specifications.

One of the key components of the antenna assembly, and a component which is critical to the antenna's ability to operate within the specified radio frequency range, is the antenna's coil assembly. Due to the difficulty of maintaining such exacting tolerances in a high production environment, most antennas produced today require some type of auxiliary adjustment method, which enables them to be individually tuned to the government mandated operating frequency.

Because it enables the antenna manufacturer to incorporate desirable features (such as mounting holes, assembly positioning features, structural integrity, and attachments points for other required components), the plastic injection molding process is often used to manufacture the coil assembly of an antenna.

Frequently, the antenna's primary component (a conductive coil typically constructed from metal), is encapsulated in a body of plastic. The process of encapsulating components in plastic is commonly referred to as insert molding. The dimension of the coil must be accurate within 0.1 millimeter (0.004 inch) for the tang and the coil.

To produce a coil assembly using the insert molding process, the following procedures are typically employed.

(1) The conductive coil constructed from metal wire (typically formed in the configuration of a common coil spring and typically manufactured on traditional spring forming machinery) is placed on a type of mandrel called a core pin.

(2) The core pin, with the coil in place, is placed into the cavity of an injection mold. The cavity is the section of the mold which has been formed into the configuration of the finished molded part. The mold is then closed.

(3) Molten plastic is injected under very high pressure into the mold cavity, (over and around the coil on the core pin) at a high rate of speed.

(4) The molten plastic is allowed to cool, the mold is opened, and the coil (now encapsulated in plastic) is removed from the core pin. The coil is now ready to be used in a cellular telephone or other wireless communication device.

In the manufacturing process described above, the high injection pressures, and high molten plastic injection speeds inherent in the injection molding process can cause undesirable movement and can change the desired dimensions of the conductive coil on the core pin. This undesirable movement, coupled with the basic inability of the coil spring manufacturer to adequately control the winding process used to manufacture the conductive coil, results in finished products with imprecisely located conductive coils.

The precise dimensional relationships of the coil assembly are critical factors, which govern the radio frequency range and performance of the characteristics of the complete antenna assembly. Some of these factors are:

(1) overall wire length of the conductive coil;

(2) overall winding length of the conductive coil;

(3) conductive coil location within the plastic encapsulation;

(4) overall conductive coil diameter; and (5) coil to coil pitch.

Because such precise dimensional control is usually unattainable in the as molded state with commonly used manufacturing practices, it is often necessary to compensate for any manufacturing discrepancies. Most often, overcoming these manufacturing inconsistencies (including, but not limited to, imprecise coil production and undesirable coil movement during molding) is a costly process which requires that each individual coil assembly be "tuned" to the proper operating frequency before the finished coil assembly can be used in production.

Therefore, it is very desirable that a method of producing coil assemblies which are useable to manufacturers of wireless communication devices in the as molded state be developed. To do so will eliminate the costly and time consuming requirement of individually tuning the antenna of each finished wireless communication device.

To produce such a pre-trued or accurately tuned antenna coil assembly requires:

(1) exceptionally tight "as molded" tolerances; and (2) greatly reduced dimensional variability of the conductive coil location, within the surrounding molded plastic, around a specified standard in its "as molded" state.

Based upon the radio frequency response requirements of each individual application, various dimensions of the conductive coil portion of the assembly can be altered. The conductive coil variables can include, but are not limited to, wire diameter, overall length, outside coil diameter, inside coil diameter, the "pitch angle" of the coil winding, and the space between the individual coils.

Since there is no such thing as a "standard" coil assembly showing, for the sake of clarity, a single representative version for the purpose of explaining the invention may be used. In this manner greatly improved dimensional control of the most critical aspects of the conductive coil, that is overall length and coil to coil pitch specifications.

Otherwise difficult to mold resins or plastics are operable herein. The particular mold design is applicable to an engineering grade plastic or resin, or to a high temperature plastic resin. The mold of this invention is designed to be filled with a resin at a lower pressure and a lower temperature than is customary in the art.

SUMMARY OF THE INVENTION

Among the many objectives of this invention is the provision of a pre-tuned antenna for a wireless communication device.

Another objective of this invention is to provide an apparatus to form a pre-tuned antenna for a wireless communication device.

Yet another objective of this invention is to provide a method of forming a pretuned antenna for a wireless communication device.

Still another objective of this invention is to provide an apparatus to form a pretuned antenna, which avoids the use of an inner core.

Additionally, an objective of this invention is to provide a method to form a pretuned antenna, which avoids the use of an inner core.

Also, an objective of this invention is to provide an antenna for a wireless communication device having a specific dimension.

A further objective of this invention is to provide an antenna for a wireless communication device having a desired function.

A still further objective of this invention is to provide an antenna for a wireless communication device having good signal quality.

Yet a further objective of this invention is to provide an antenna for a wireless communication device tuned to a desired frequency.

Another objective of this invention is to provide an antenna for a wireless communication device, which rejects unwanted radio frequencies.

Yet another objective of this invention is to provide an antenna for a wireless communication device, which avoids fading reception.

Still another objective of this invention is to provide an antenna for a wireless communication device, which has consistent performance.

Additionally, an objective of this invention is to provide an antenna for a wireless communication device, which has extremely exacting tolerances and specifications.

Also, an objective of this invention is to provide an antenna for a wireless communication device, which has difficult to reproduce tolerances and specifications.

A further objective of this invention is to provide an antenna for a wireless communication device to operate within a specified radio frequency range.

A still further objective of this invention is to provide an antenna for a wireless communication device having a good coil assembly.

Yet a further objective of this invention is to provide an antenna for a wireless communication device, which avoids an auxiliary adjustment.

These and other objectives of the invention (which other objectives become clear by consideration of the specification, claims and drawings as a whole) are met by providing an antenna for a wireless communicating device set at a precise frequency, in the as formed state. To accomplish these desired results, a coil antenna is precisely held in a mold, while an appropriate plastic is molded therearound, with no distortion of the coil, to fix a precise shape for the coil. The recovered, plastic-encased coil requires little or no follow-up treatment before it can be used in a wireless communication device as an antenna.

BRIEF DESCRIPTION OF DRAWINGS

FIG. 9 depicts a top 220 of mold 200 as a reverse positioning of FIG. 8.

FIG. 10 depicts a bottom 240 of mold 200 as a reverse positioning of FIG. 8.

Throughout the figures of the drawings where the same part appears in more than one figure the same number is applied thereto.

DESCRIPTION OF THE PREFERRED EMBODIMENTS

Figure 1:
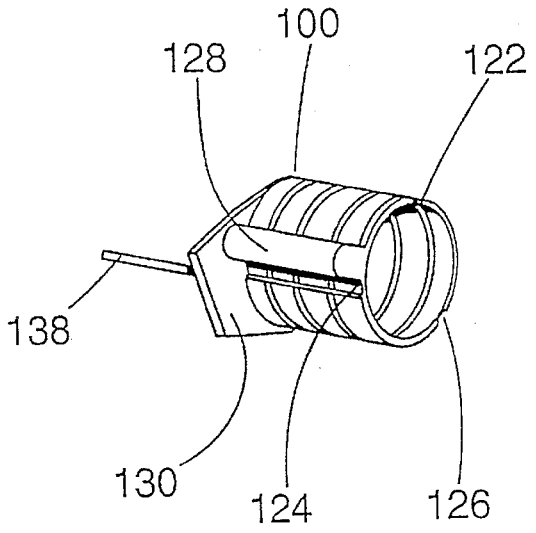
FIG. 1 depicts a top, perspective view of an antenna 100 of this invention.
Figure 2:
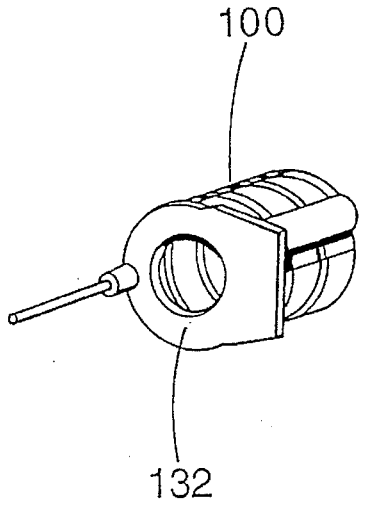
FIG. 2 depicts a bottom, perspective view of an antenna 100 of this invention, which is a reverse view of FIG. 1.
Figure 3:
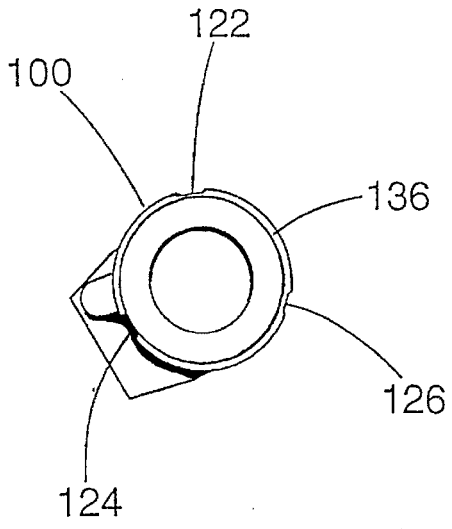
FIG. 3 depicts a top, plan view of an antenna 100 of this invention, based on FIG. 1.
Figure 4:
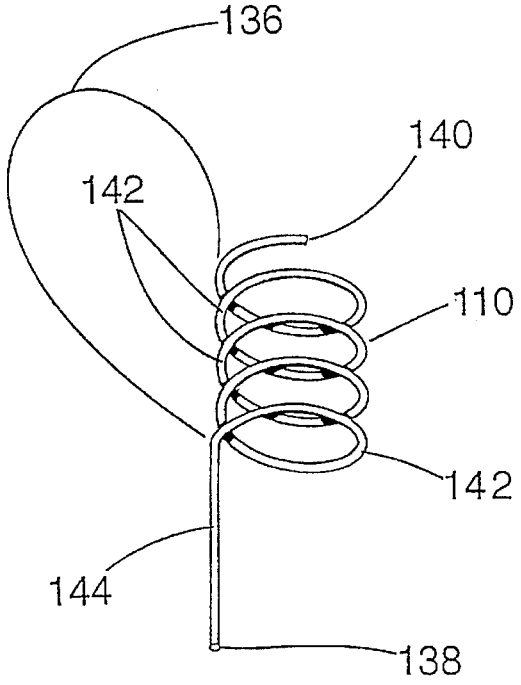
FIG. 4 depicts a side, perspective view of a coil 110 for an antenna 100 of this invention.

An antenna coil is formed by holding the coil in the mold in the precise position. A handle supports at least one coil in the precisely desired position. The handle is then inserted into the mold. The coil on the handle is further supported by the mold. An appropriate resin or plastic substance is then injected into the mold around each coil. The resin is cooled. The resulting antenna is then recovered.

Pressure pads within the mold contact the outside of the coil, and combine with a top holding device and a bottom holding device to hold the coil on the handle in a precisely desired position. A resin is then injected into the mold in order to seal that coil in the precisely desired position, due to its precisely positive, substantially immovable location during molding.

In other words, each coil used in the antenna must have a predetermined shape and size. Each coil must be held at the predetermined shape and size while the plastic substance is applied thereto, and then cooled. In this fashion, the precise position of the coil is set, and the precise structure of the antenna is predetermined. The molding method then permits recovery of an antenna with little or no after molding treatment.

Thus, the 0.1 millimeter (0.004 inch) is maintained at the top end stop, and the tang end or bottom end of the antenna coil. The tang end is positively positioned on the handle with a bottom stop. With this holding, the desired results are achieved and the coil is specifically positioned.

The process and apparatus herein disclosed do not rely on, or need, or use an integral, inner core member to achieve the dimensional accuracy or frequency desired for the end product. The reliance and associated expense of a multi-step inner core member process is virtually eliminated.

The pressure pads hold the coil while the plastic is applied or injected into the mold. The fact that the pressure pads may leave part of the coil exposed through the plastic is not a problem, as long as the coil is held in the proper position. Pressure pads also serve to hold the desired diameter of the coil. The gate of the coil and the pressure relief provides for relief from any pressure caused by the injection of the resin and misshaping of the coil.

The invention further detailed below describes a novel construction method, part design, tooling process and manufacturing technique for producing a high precision, insert molded, coil assembly for use as an antenna in a wireless communication device. A typical includes wireless communication device includes, but is not limited to, a cellular telephone, a pager, and similar devices.

The basis of the invention is to permit the coil assembly manufacturer to produce an insert-molded, high precision coil assembly, which is able to be used in its "as molded" state, and requires no costly and time consuming calibration or pretuning prior to, or after, its installation on the communication device assembly line.

The configuration of the specific coil assembly shown below is meant to be representative, but not limited to, the type of high precision coil assembly which may be manufactured by incorporating the features of the invention. This coil assembly is designed to be used as an antenna in wireless communication devices with little or no treatment after molding. It especially desirable to use the antenna in the as molded state.

With the positioning of the coil and the positive location thereof, the pitch to pitch stability of each loop in the coil is achieved. Also with the positioning of the coil at the top and the bottom thereof, a preset position for pretuning of the antenna is achieved. The pressure pad holds the coil within the resin area. There is a release of the pad which permits efficient encapsulation of the coil.

For cellular telephones, it is highly desirable to manufacture the antennas in large quantities, while maintaining consistent and predictable electrical results. The consistency leaves little error and little flexibility. The range between the top and the bottom end of the coil must be within 0.1 millimeter (0.004 inch).

The key reason for having the antenna tuned properly is so that the distributive capacitance of the coil can be relied on to form the desired resonance circuit. Also, it is important that no variable reception means for the antenna be permitted. Injection molding techniques can achieve the desired results.

However, it is critical that the coil be properly positioned within the mold and held until the proper plastic or resin is injected at the proper time with the proper temperature in the proper position. The use of helical antennas is well known for communication devices. Specifically, these communication devices operate in the very high frequency range (VHF) and lower portion of the ultra high frequency range (UHF). These antennas may be physically shorter than the standard antenna.

A helical antenna is constructed by winding the helical coil and then encasing the coil in a plastic sleeve. After encapsulation, the coil must customarily be trimmed. This trimming is now avoided with great savings of time, labor and expense. Close tolerances from this encapsulation for the coil in order to achieve the desired resonance of the encapsulated coil and the resulting antenna require little or no trimming when compared to prior processes.

Trimming is required to adjust the frequency resonance of antennas formed by the prior art. This adjustment is required because the various parameters, such as the pitch of the helical coil, can be changed during construction. Therefore, it is not possible to precut the antenna to the desired resonance frequencies prior to molding the plastic therearound.

The coil and hence the antenna must maintain close dimensional tolerances. This is required so that the inductiveness of the antenna can achieve the desired result for the desired frequency. The dimensional tolerances are equally important with the required inductiveness.

Referring now to FIG. 1, FIG. 2, FIG. 3, and FIG. 4, the antenna 100 of this invention is depicted. The antenna includes a coil 110. Coil 110 is encapsulated in a resinous or plastic substance 132. The plastic substance 132 is any suitable, injection-moldable, shapeable material having the appropriate electronic properties for coating coil 110 to form antenna 100. A typical plastic substance 132 may be selected from engineering grade plastic or resins described in U.S. Pat. No. 5,336,075 to Stephen A. Motisi. Plastic substance 132 is usually a thermoplastic resin.

Coil 110 includes a central circular coil portion 136; bottom end, or tang end 138; and a top end 140. Tang end 138 includes a rod 144. Rod 144 extends from central coil 136 and is parallel to the central axis of central coil 136.

Figure 11:
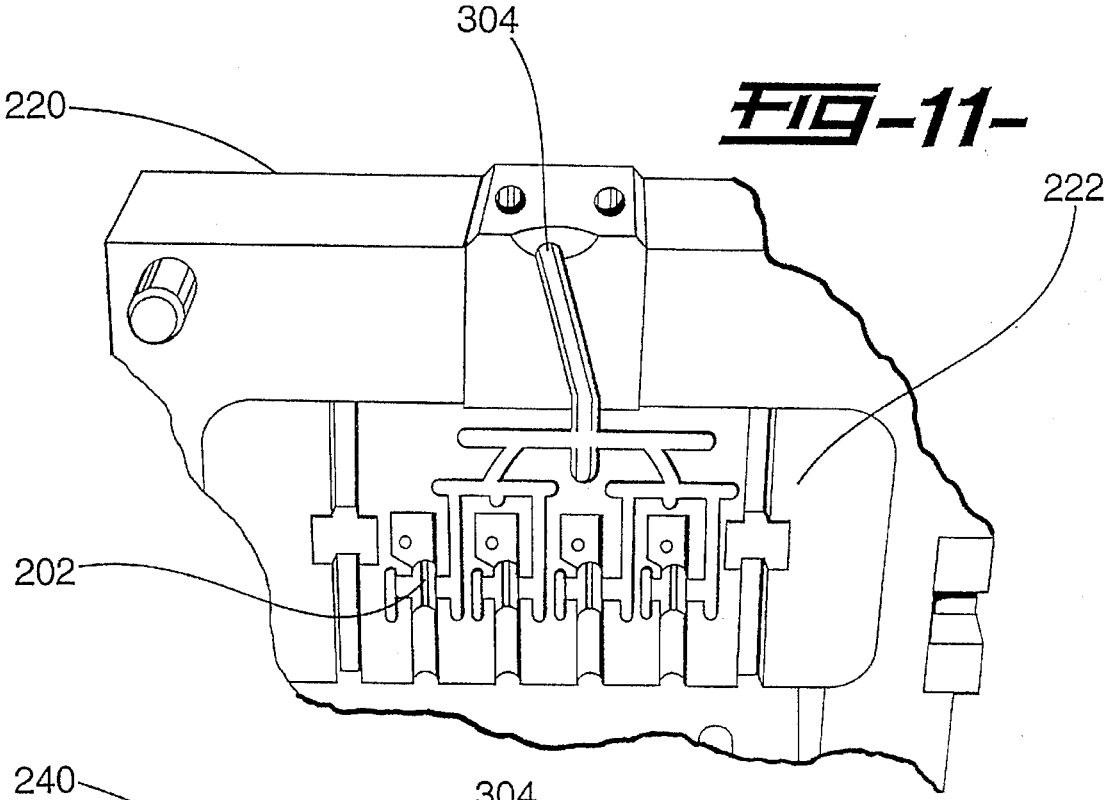
FIG. 11 depicts a magnified view of first shaping part 222 of mold top 220 of mold 200 shown in FIG. 9.

A first groove 122 appears in plastic substance 132 exposing coil 110 substantially tangential to coil 110 and parallel to the central axis thereof and is formed by a top mold pad 202 (FIG. 11). Two other grooves are present and mutually spaced at 120 degree angles from first groove 122 and each other.

The second groove 124 being due to a first mold pinch bar 244 and the third groove 126 being due to a second mold pinch bar 246. Adjacent to second groove 124 is a molding ridge 128.

Base platform 130 is customarily tangential to the tang end 138 of the antenna 100. The top end 140 is oppositely disposed from the base platform 130. The antenna 100 is basically a hollow cylinder with the plastic substance 132 molded around a central coil 136. More particularly, the bottom or tang end 138 and the top end 140 are specifically shown in FIG. 4.

The central coil 136 includes a series of loops 142. The shape and spacing of loops 142 are critical and must be held in proper position within 0.1 of a millimeter. This is accomplished by the structure of mold 200.

Figure 5:
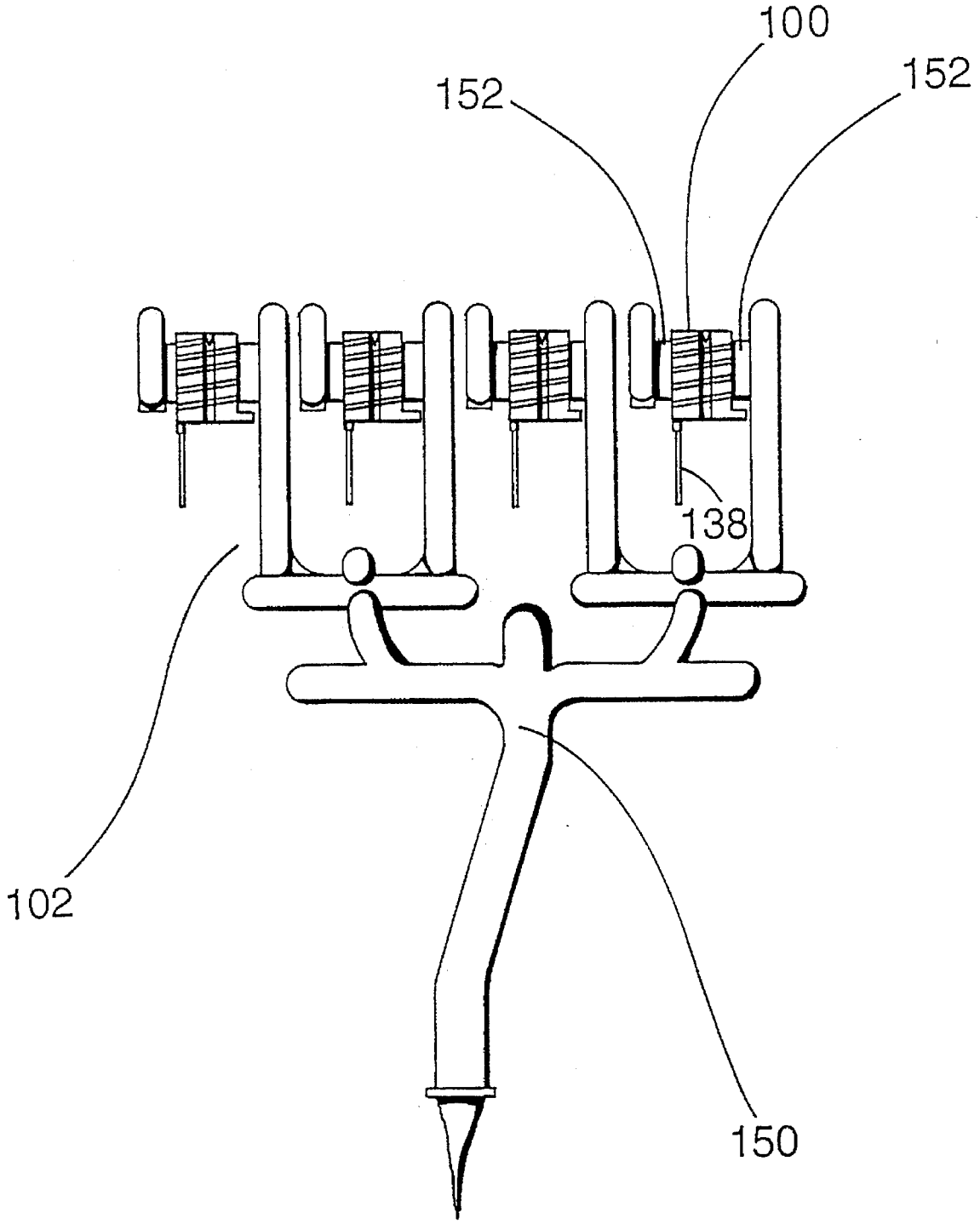
FIG. 5 depicts a side, perspective view of an as molded assembly 102 for four of antenna 100 of this invention.
Figure 8:
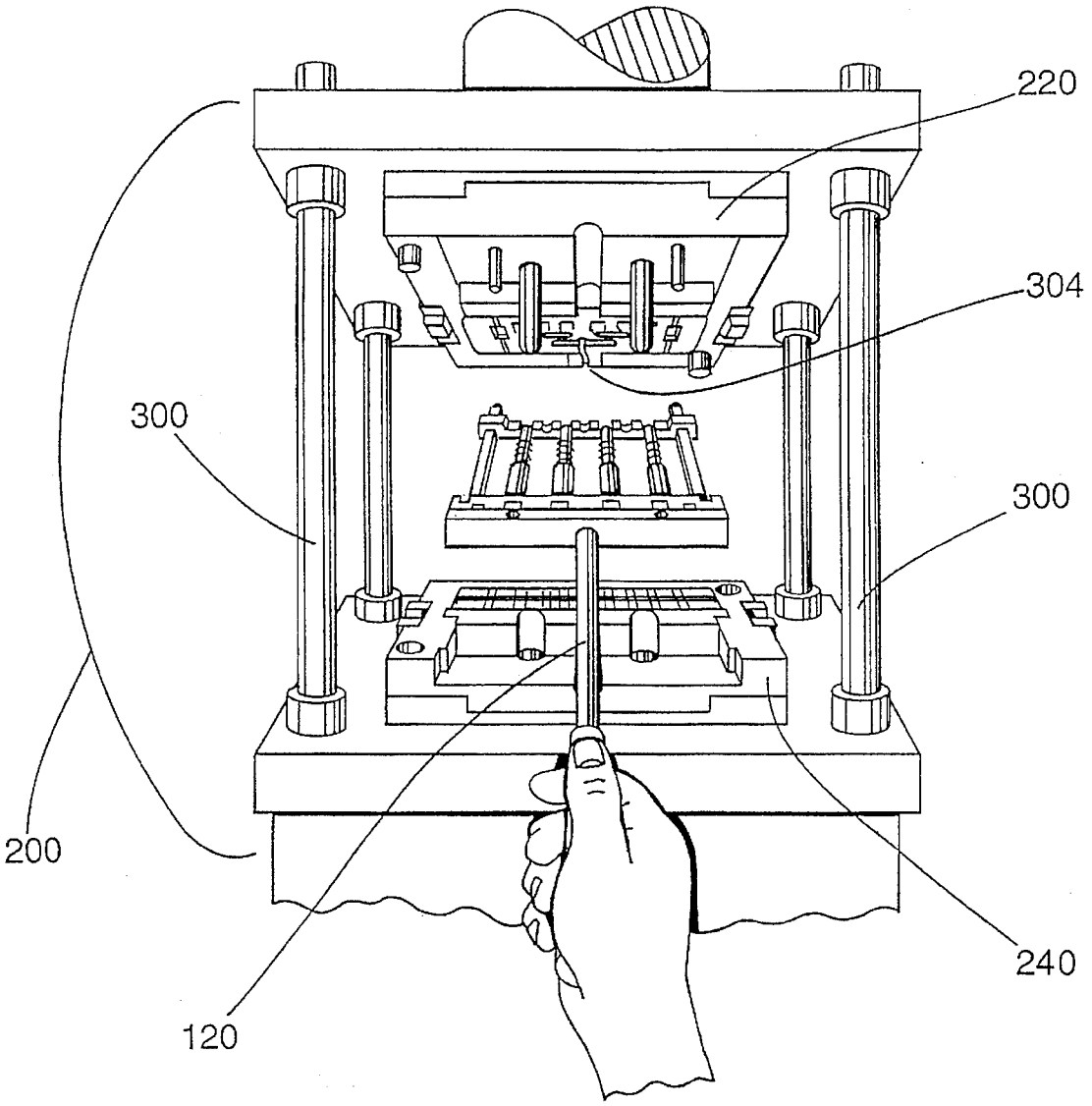
FIG. 8 depicts an end, perspective view of a handle assembly 120 being inserted into a side, perspective view of mold 200.

In FIG. 5, the as molded antenna 100 are seen. A shaped plastic mass may be removed from the mold 200 (FIG. 8). This shaped mass is plastic molded mass described as molded assembly 102, shown in this embodiment with four of antenna 100 thereon. It includes plastic substance 132 hardened around coil 110, while coil 110 is held in particular dimensions.

Residue 150 thereof is separated from each antenna 100 in order to recover the antenna 100, by simply breaking a plurality of thin straps 152, formed in the shaping process by mold 200. Straps 152 are situated between residue 150 and antenna 100. The antenna 100 may then be used in a communication device, with little or no subsequent treatment.

Figure 6:
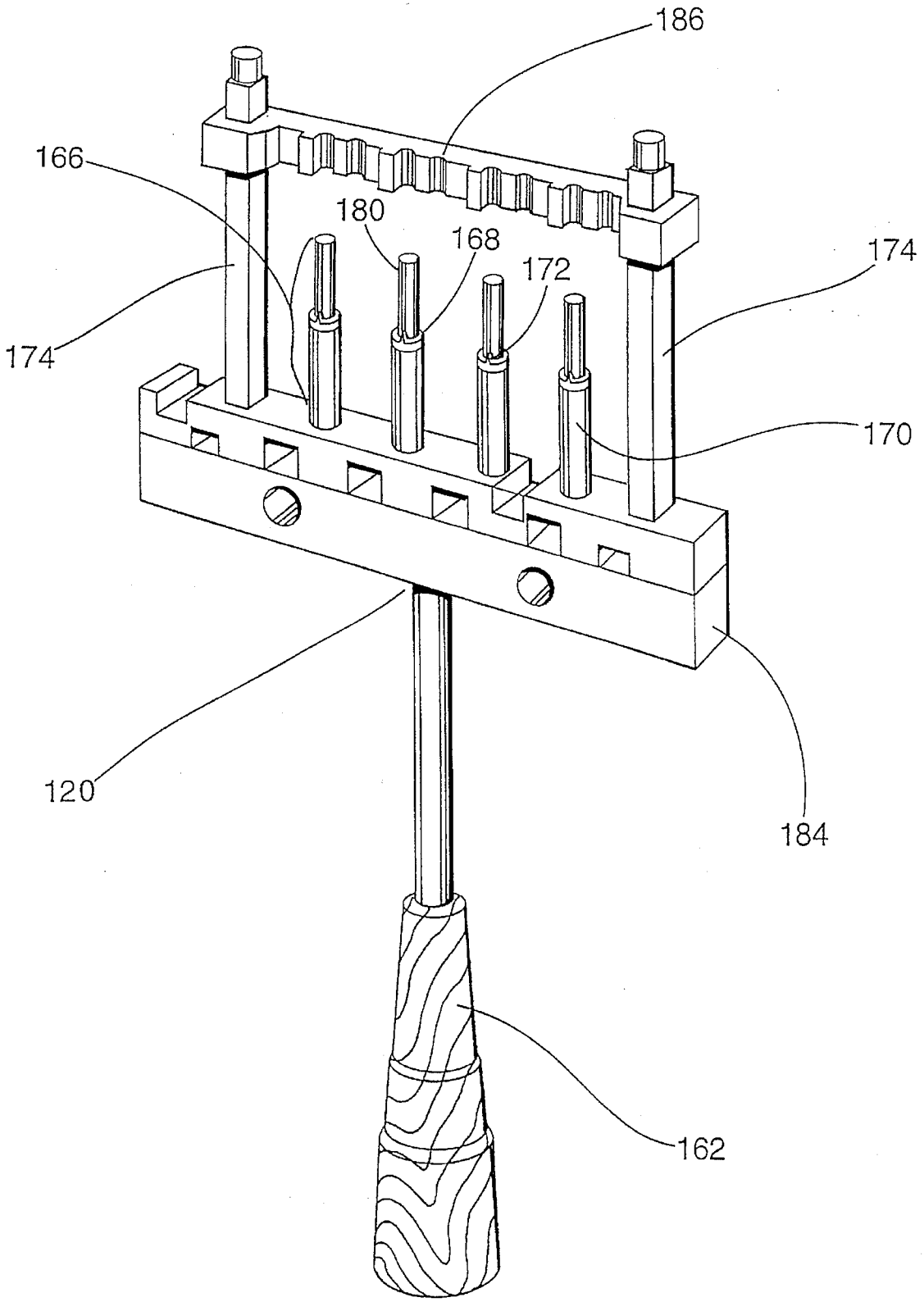
FIG. 6 depicts a side, perspective view of a handle assembly 120 suitable for holding coil 110 while antenna 100 of this invention is being formed.

With FIG. 6 showing handle assembly 120, it can be seen how as molded assembly 102 is formed. Handle assembly 120 includes a gripping support 162, a coil receiving support 184, a sliding bar 186 and a pair of bar supports 174.

Gripping support 162 permits handle assembly 120 to be held and inserted into mold 200 after coils 110 are placed thereon. Gripping support 162 is secured to coil receiving support 184 at a central portion thereof in a substantially perpendicular relationship.

The bar supports 174 are mounted at each end of coil receiving support 184 also in a substantially perpendicular relationship. However bar supports 174 are on a side of coil receiving support 184 oppositely disposed from gripping support 162.

Bar supports 174 receive the sliding bar 186. Sliding bar 186 slides around coil pipe 180 to contact bottom end, or tang end 138 of coil 110. This contact combines with twist stop 172 to hold each end of coil 110. Below described top mold pad 202 and bottom pinch bars 244 and 246 complete the hold on coil 110 at the appropriate spot, while the plastic substance 132 is applied.

While FIG. 6 depicts four of coil receiving member 166 on coil receiving support 184, each capable of receiving a coil 110, this number can, of course, be adjusted. This number and the corresponding structure therefor increases or decreases depending on the appropriateness of the manufacturing process.

Figure 7:
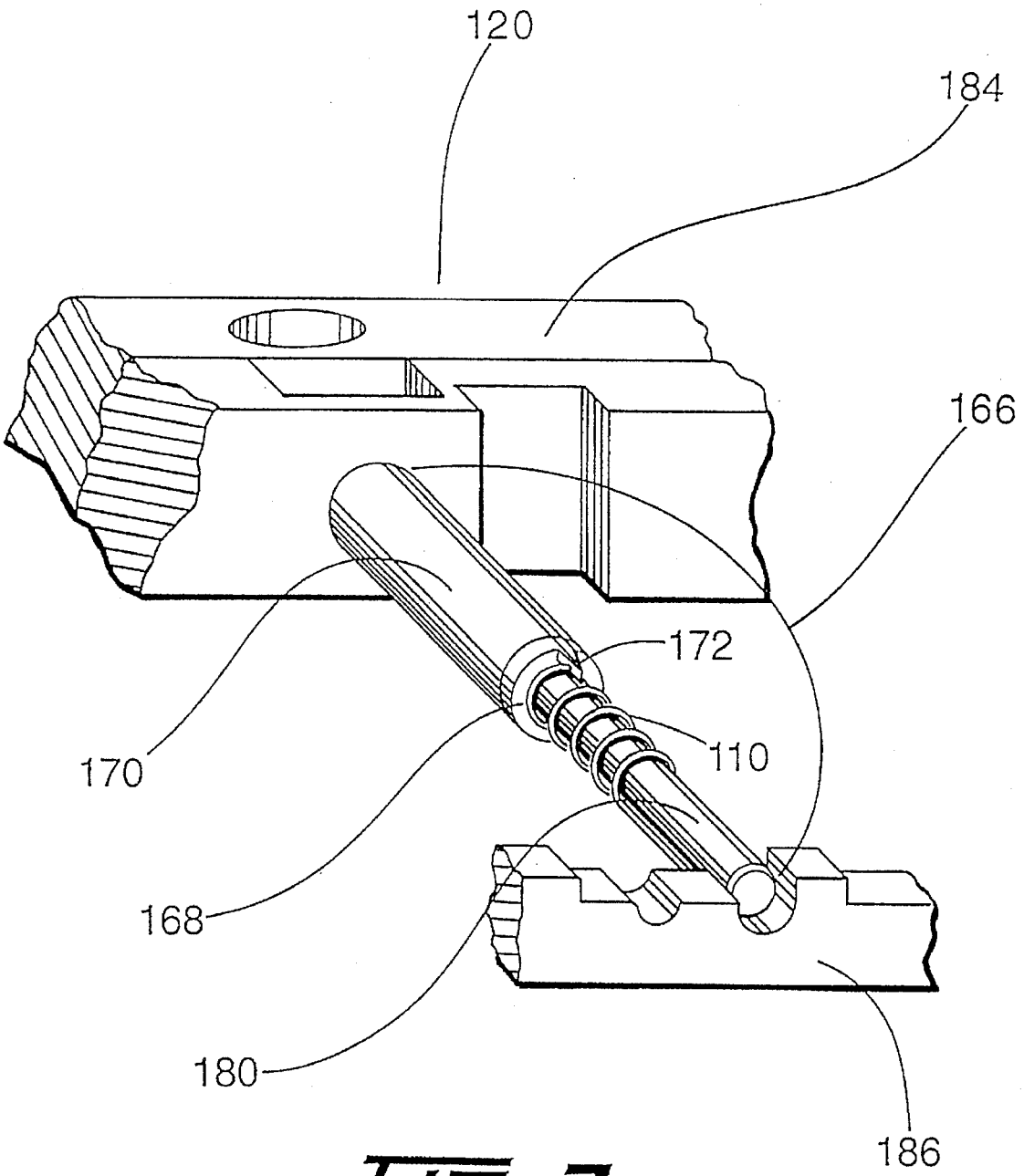
FIG. 7 depicts an end, perspective view of part of handle assembly 120 suitable for holding coil 110, while antenna 100 of this invention is being formed.

Adding FIG. 7 to the consideration, each coil 110 is mounted on a coil receiving member 166 of coil receiving support 184. Each coil receiving member 166 has a top end receiving device 168 which holds the top end 140 in proper position.

A first groove 122 is formed by the top mold pinch bar called top mold pad 202 for the purposes herein. Two other grooves are present at 120 degree angles therefrom, the second groove being 124 and the third groove being 126. Adjacent to second groove 124 is a molding ridge 128. Base platform 130 is tangential to the tang end 138 of the antenna. The top end 140 is oppositely disposed from the tang end 138.

Gripping support 162 provides a means for gripping the handle assembly 120 and inserting the same in the mold 200. The coil receiving support 184 also includes an enlarged base 170. Enlarged base 170 has a larger diameter than the interior diameter of the coil 110. The enlarged base 170 extends from the gripping support 162 of handle assembly 120 and has a twist stop 172 adjacent to the enlarged base 170 and protruding upwardly therefrom.

The top end 140 of the coil 110 contacts the twist stop 172 and holds the coil 110 at the top end 140. The twist stop 172 is merely an extension of enlarged base 170.

The handle assembly 120 includes a gripping support 162 so that the handle assembly 120 may be held at one end thereof and a sliding bar 174 at the other end thereof. Therebetween is the coil receiving support 184. The coil receiving support 184 has mounted thereon the coil receiving member 166, which includes the enlarged base 170 and coil pipe 180. The enlarged base has a diameter of sufficient size to stop the coil 110 at the top end 140 thereof at an appropriate point. The coil pipe 180 has a diameter of sufficient size to receive the coil 110.

There is a mechanism of a twist stop 172 on each coil receiving support 184, which stops the top end 140 of the coil 110 at a particular point on the coil pipe 180 adjacent to the enlarged base 180. Coil pipe 180 combines with enlarged base 170, so that it extends above coil receiving support 184, with a diameter smaller than the diameter of enlarged base 170. Coil pipe 180 thus receives coil 110 at the central coil 136.

FIG. 8 brings the mold 200 into the consideration. In the embodiment shown, four (4) of coil receiving member 166 are depicted on handle assembly 120 and are inserted into the mold 200 with handle assembly 120. FIG. 9 and FIG. 10 combine to clarify the structure of mold 200.

The mold 200 includes a top member 220 and bottom member 240. Within the bottom member 240, is a handle receiver 262. The handle receiver 262 (FIG. 9) positions the handle assembly 120 properly and permits the coils 110 to rest thereon during the molding process. The gripping support 162 and the mold 200 structure are specifically designed to hold the handle assembly 120 in the appropriate position, within mold 200.

As a further support for positioning of top member 220 and bottom member 240, are corner guides. Corner guides include diagonally opposed corner posts 354 on top member 220, corresponding corner apertures 356 on bottom member 240.

The mold 200 includes the appropriate locking members 350 and the handle apertures 352 to support the handle assembly 120 in the desired place. Upper locking posts 256 on top member 220 and lower locking posts 254 on bottom member 240 within the mold 200 hold the handle assembly 120 at the precise location desired. Guide holes 250 in the bottom member 240 of the mold 200 receive large guide posts 252.

Upper small locking posts 256 are shown as four in number to be received by small guide apertures 258. Small guide apertures 258 are located in bottom member 240.

Guide posts 252 in the top member 220 of the mold 200 assure proper alignment of the mold. In this fashion, not only can the proper amount of plastic substance 132 be injected into the proper position, the desired structure and positioning of the coil 110 can be achieved.

Figure 12:
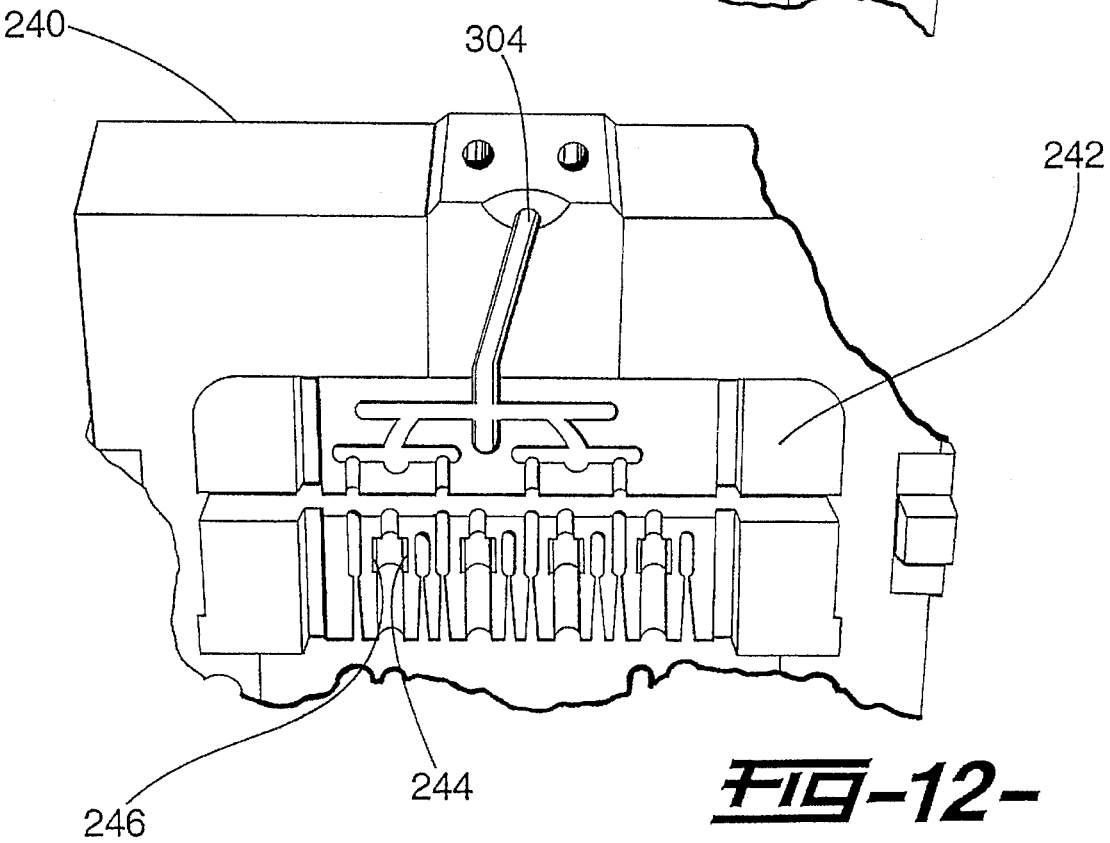
FIG. 12 depicts a magnified view of second shaping part 242 part of mold bottom member 240 of mold 200 shown in FIG. 10.

FIG. 11 and FIG. 12 explain the grooves in antenna 100 and the holding of the handle assembly 120. The mold 200 also includes a top mold pad 202 and bottom pinch bars 244 and 246 to contact the coils 110 at the appropriate spot. The top member 220 also combines top mold pad 202 with the bottom pinch bars 244 and 246 to form at substantially 120° degree angles from each other.

The first groove 122 is formed by top mold pad 202. The second groove 124 is due to the first mold pinch bar 244, and the third groove 126 is due to a second mold pinch bar 246. Adjacent to second groove 124 is a molding ridge 128 formed by ridge cavity 248 in bottom member 240.

The top member 220 has therein the first shaping part 222 of the mold 200. The bottom member 240 has therein second shaping part 242 of the mold 200. The first shaping part 222 and the second shaping part 242 cooperate to form the as molded assembly 102.

The top member 220 of the mold 200 and the bottom member 240 of the mold 200 are brought together in any typical fashion such as by hydraulic members. This is accomplished along mold supports 300 preferably four in number in each corner of the top member 220 of the mold 200 and the bottom member 240 of the mold 200.

Figure 13:
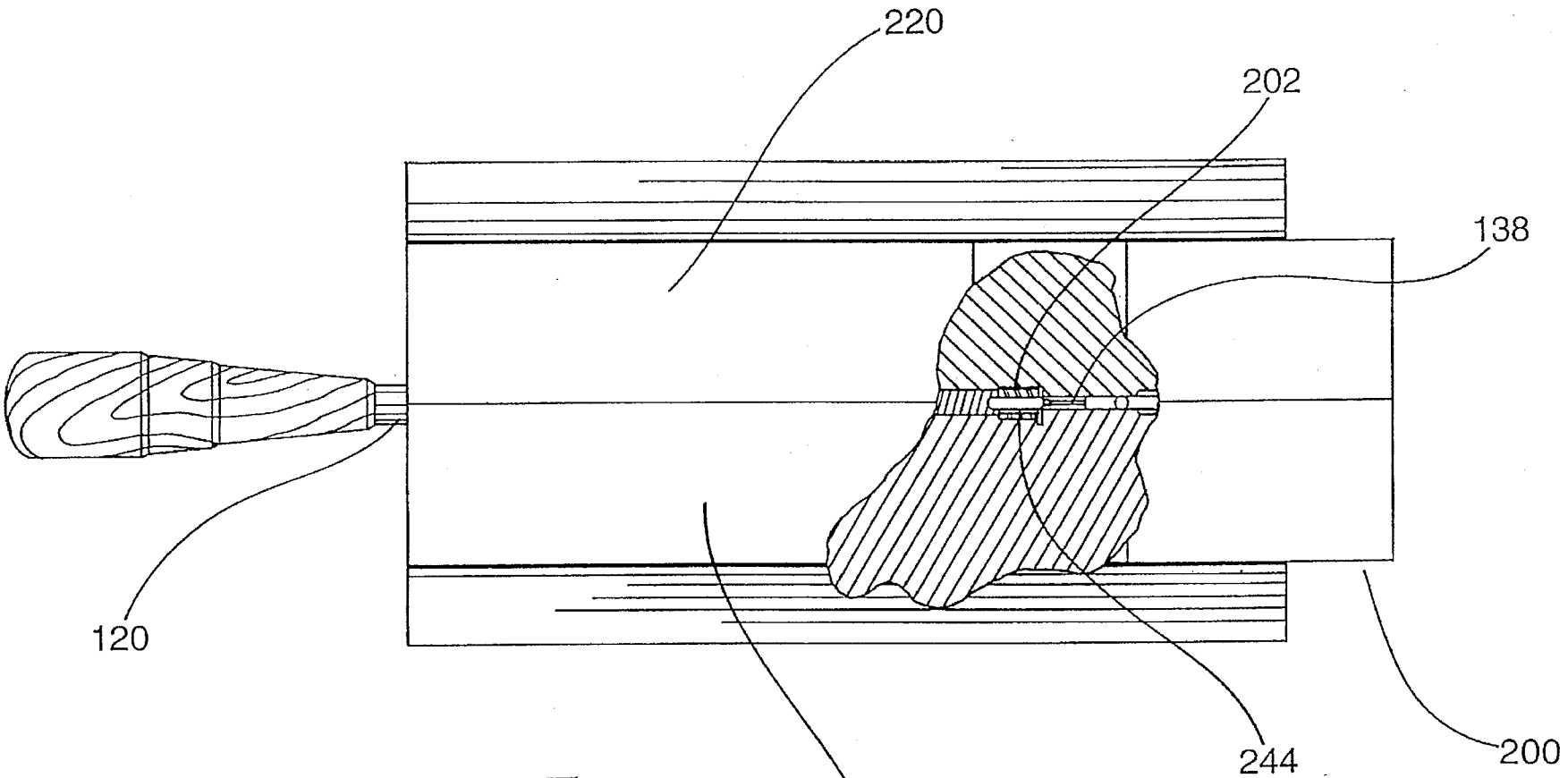
FIG. 13 depicts a side view of mold 200 in partial cross-section closed around handle assembly 120.
Figure 14:
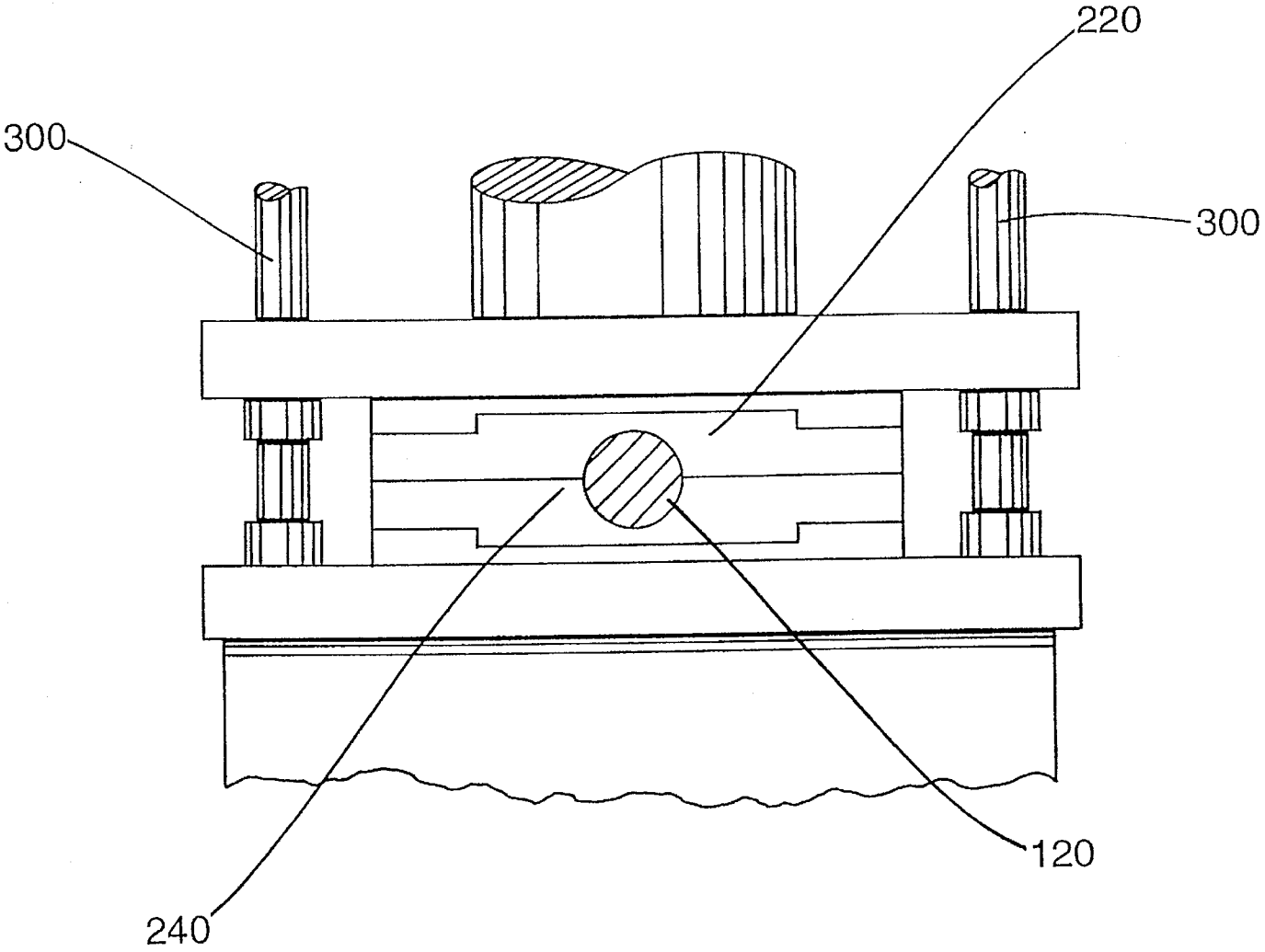
FIG. 14 depicts an end view of handle assembly 120 in partial cross-section with mold 200 closed therearound.

As can be seen in FIG. 13 and FIG. 14, after the mold 200 is closed, it is feasible to inject plastic substance 132 therein. The plastic substance 132 must be sufficiently strong and non-interfering with transmission to permit the antenna 100 to be held and formed. Between the handle assembly 120 and the pinch bars 202, 244 and 246, the coil 110 is held in precisely the right position until the plastic substance 132 is applied thereto and cooled. In this fashion, the antenna 100 may be recovered from the as molded assembly 102 of FIG. 5 and the resulting antennas 100 separated therefrom.

Figure 15:
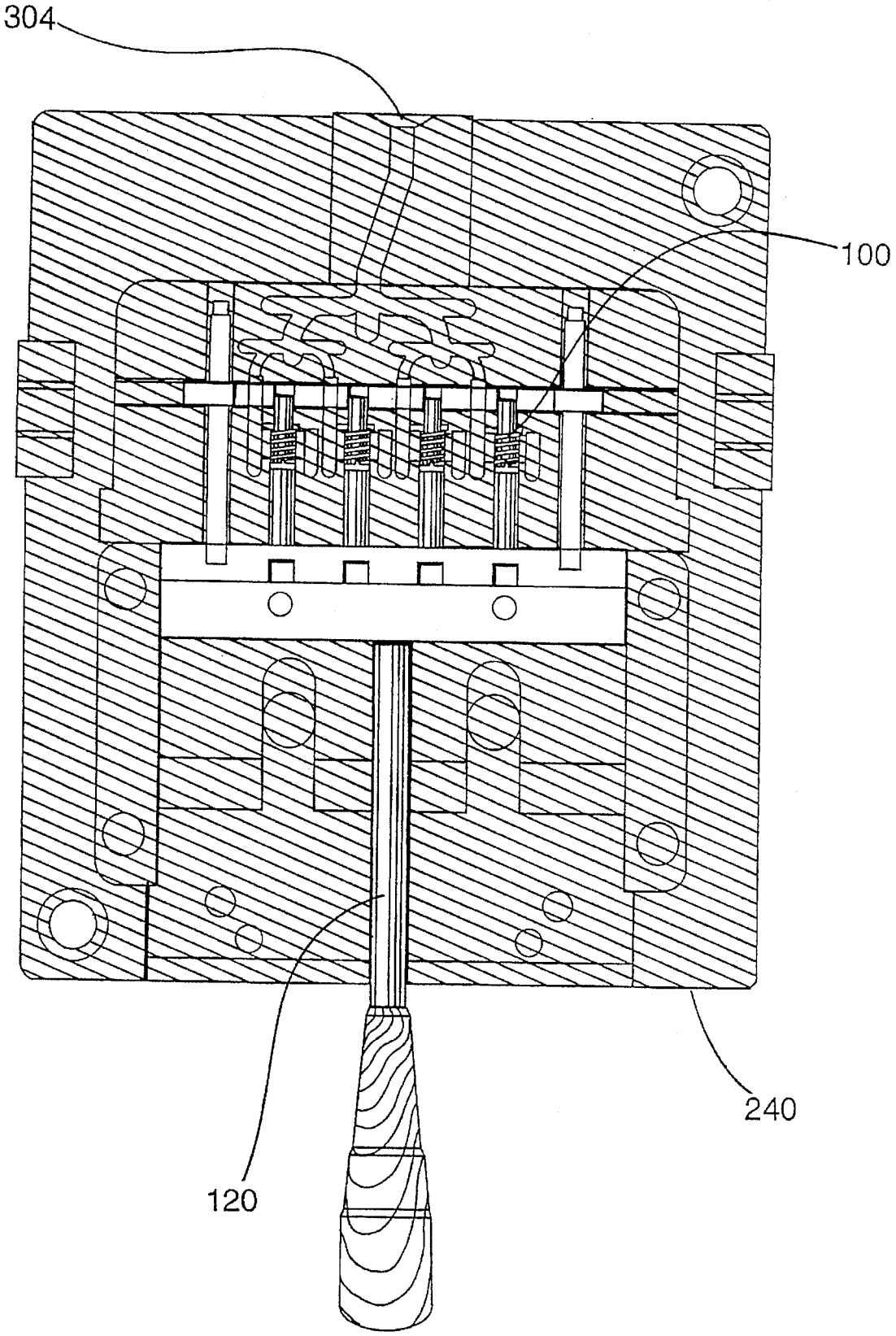
FIG. 15 depicts a top, plan, cross-sectional view of mold 200 closed around handle assembly 120.

As the top member 220 and the bottom member 240 come together, oppositely disposed from the handle end 302, is an injection port 304 best indicated in FIG. 15, but shown in FIG. 9 and FIG. 10. Through this injection port 304, the appropriate plastic substance 132 is inserted. Appropriate tubes 306 guide the plastic substance 132 around the antenna 100 at the points desired.

Figure 16:
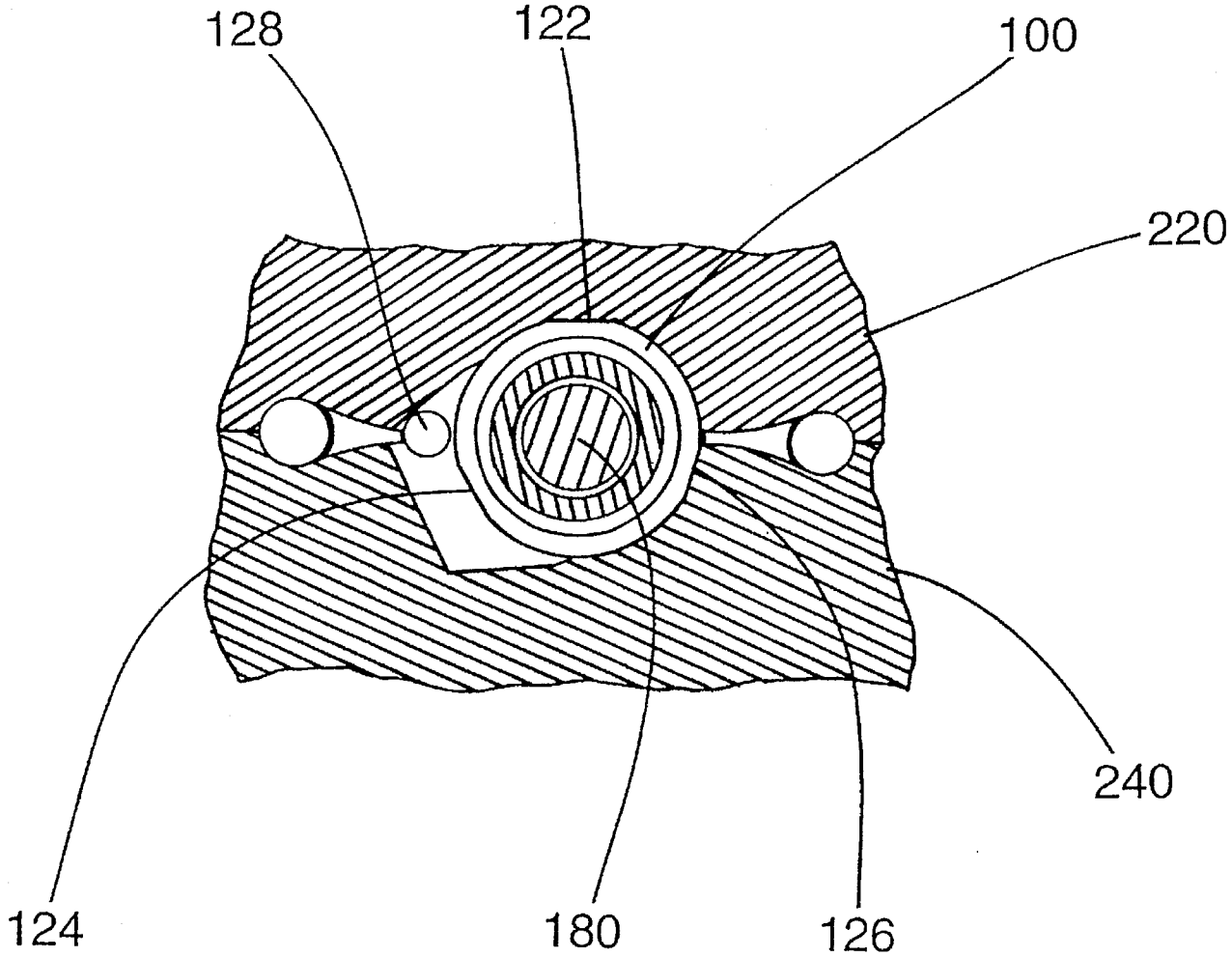
FIG. 16 depicts an end partial, cross-section of mold 200 closed around one antenna 100.

FIG. 16 makes clear the holding of the coil 110. Due to the presence of the handle assembly 120 and the pinch bars 202, 244, and 246, the coils 110 do not move as the plastic substance 132 applied thereto. The plastic substance 132 is adjusted for appropriate viscosity and molding capability, and electronic transmission and reception, the adjustment being well within the scope of a person having ordinary skill in the art to do so.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An antenna for a wireless communication device having a precise dimension, comprising:

(a) a coil having a precise dimension;

(b) an encapsulating material holding the coil in the precise dimension;

(c) the encapsulating material being a thermoplastic resin;

(d) the antenna being suitable for use in at least one wireless communication device;

(e) the antenna having a hollow, cylindrical shape formed the encapsulating material around the coil;

(f) the coil having a top end and a bottom end;

(g) the antenna having a platform substantially perpendicular to the cylindrical shape at the bottom end;

(h) a tang extending from the bottom end;

(i) the encapsulating material having at least one radially spaced groove parallel to a central axis of the cylindrical shape; and (j) a molding ridge parallel to the at least one radially spaced groove.

2. The antenna of claim 1 further comprising:

(k) the at least one radially spaced groove being three radially spaced grooves parallel to a central axis of the cylindrical shape; and (l) said molding ridge parallel to one of the three grooves.

3. The antenna of claim 2 further comprising:

(m) the coil including a series of loops between the top end and the bottom end;

(n) a first end of the series of loops terminating at the top end;

(o) the tang extending from the bottom end of the coil to the series of loops; and (p) a second end of the series of loops being adjacent to the tang.

4. The antenna of claim 3 further comprising:

(q) the antenna having a base platform formed from the encapsulating material;

(r) the base platform being a substantially flat member of the antenna; and (s) the base platform being situated at the second end of the series of loops and perpendicular to the tang.

5. The antenna of claim 4 further comprising:

(t) the coil having a pitch to pitch stability;

(u) each in the series of loops having a tolerance of 0.1 millimeter in order to provide a distributive capacitance for the coil to form a desired resonance circuit.

* * * * *